US005493301A

United States Patent [19]

Bossoli et al.

[11] Patent Number: 5,493,301

[45] Date of Patent: Feb. 20, 1996

[54] SPIN DETERMINATION OF KE PROJECTILES

[75] Inventors: Robert Bossoli, Havre De Grace; Eugene Ferguson, Baltimore, both of Md.

[73] Assignee: The United States of America as represented by the Secretary of the Army, Washington, D.C.

[21] Appl. No.: 230,953

[22] Filed: Apr. 21, 1994

[51] Int. Cl.[6] ..... H01Q 15/18

[52] U.S. Cl. ..... 342/6; 342/7; 342/67

[58] Field of Search ..... 342/6, 7, 9, 62, 342/67, 188

[56] References Cited

U.S. PATENT DOCUMENTS

| | | | |
|---|---|---|---|
| 2,472,212 | 6/1949 | Hudspeth | 342/188 |
| 3,114,911 | 12/1963 | McNutt | 342/7 |
| 3,320,614 | 5/1967 | Jedrey, Jr. | 342/188 |
| 4,037,228 | 7/1977 | Pearson | 342/7 |
| 4,072,948 | 2/1978 | Drews et al. | 342/6 |
| 5,007,721 | 4/1991 | Morris et al. | 342/6 X |

OTHER PUBLICATIONS

"Technique for Measuring the Spin Rate of kinetic Energy Projectiles" Ferguson et al, APL–MR–60 Apr. 1993.

*Primary Examiner*—Mark Hellner

*Attorney, Agent, or Firm*—Freda L. Krosnick; Frank J. Dynda

[57] ABSTRACT

A technique for determining the spin history of kinetic energy penetrator projectiles. The method employs a special dihedral plug fitting in the rear (tracer well) of the penetrator projectile that produces a modulation of the tracking radar's signal. This signal is recorded and analyzed to yield the rotation rate of the projectile as it travels down range.

5 Claims, 14 Drawing Sheets

DIMENSIONS IN MM

SPIN DETERMINATION OF KE PROJECTILES

RIGHTS OF THE GOVERNMENT

The invention described herein may be manufactured, used and licensed by or for the United States Government for Governmental purposes without payment to us of any royalty thereon.

BACKGROUND OF THE INVENTION

1. Field of the Invention

This invention discloses a new technique for determining the spin history of kinetic energy (KE) penetrator's. The method employs a special dihedral plug fitting into the rear (tracer well) of the KE penetrator to modulate a tracking radar's signal. This signal is recorded and analyzed to yield the rotation rate of the projectile as it flies down range. The dihedral plug has been tested with a Doppler range radar (HAWK AN/MPQ-33 X-band radar) but could also be exploited with non-Doppler radars provided enough output power is available.

2. Discussion of Prior Art

Knowledge of the spin history of kinetic energy (KE) penetrators (as for any projectile) is vital to designers in order to keep the spin frequencies below structural limits. Radar data have been used for measuring the spin of artillery projectiles where large features are present to produce modulated radar return signals from the rotation of the projectile.

The small size and features (see FIG. 1, section 6) of a KE penetrator provide for a meager radar cross section (RCS) and have prevented spin information from being extracted from the radar tracking data of these projectiles. Alternate techniques, such as using yaw cards which are described in Pennekamp, R. A., *"Yaw and Spin Characteristics of the XM900E1 Model 545 APFSDS-T PROJECTILE,"* Ballistic Research Laboratory, APG, MD, BRL Report TR3846, June 1990. (AD B145808) have been used, but they are expensive, labor intensive, and can yield misleading results if the spin is atypical. Techniques employing high-speed framing cameras can be used, but only cover a small fraction of the projectile's flight.

SUMMARY OF THE INVENTION

The technique of using a dihedral plug (replacing the tracer) to determine, via analysis of radar tracking data, the spin history of KE penetrators has the benefits of being easily implemented and very inexpensive. It has been demonstrated with Doppler X-band radar (HAWK), which is utilized at many test ranges for measuring the velocity history of projectiles. Hence, in many cases, no new instrumentation is needed, only a variation in the analysis of the recorded data. For test facilities with alternative radar systems, this technique should be applicable, provided that the type of tracking radar is a fairly high-power standard or Doppler X-band.

BRIEF DESCRIPTION OF THE DRAWINGS

A better understanding of the invention will be obtained when the following detailed description of the invention is considered in connection with the accompanying drawings in which.

DETAILED DESCRIPTION OF THE INVENTION

Figure 1:
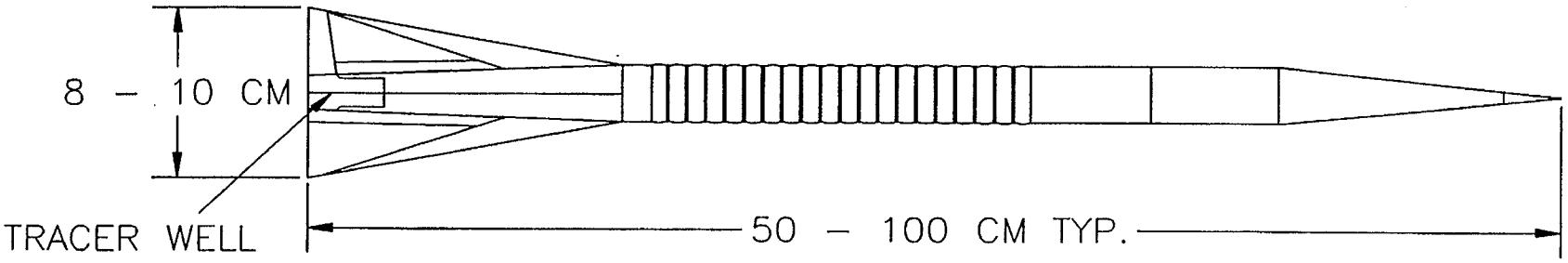
FIG. 1 Typical dimensions of kinetic energy penetrators fired by US 105 or 120-mm tank guns.
Figure 2:
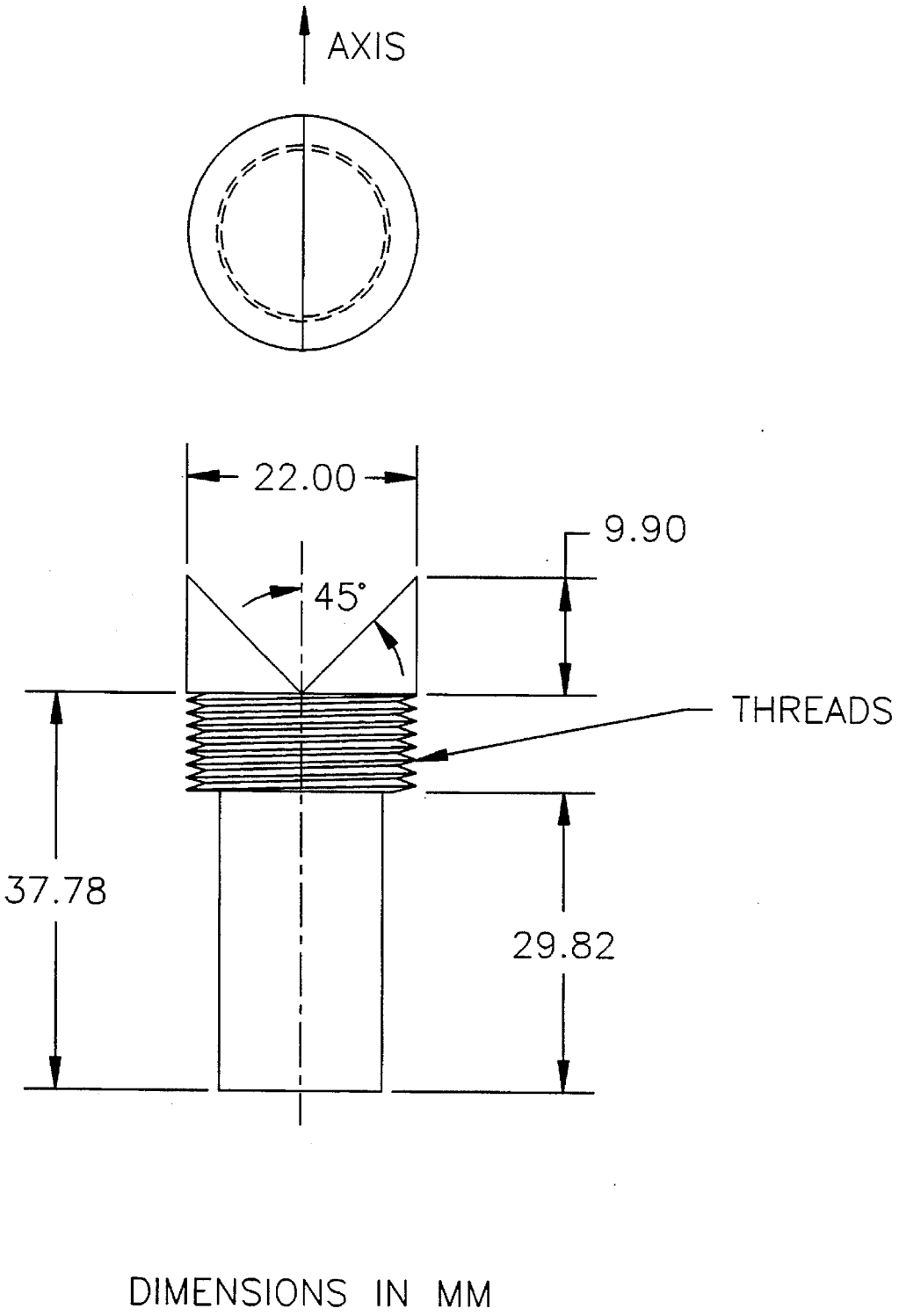
FIG. 2 Diagram of the dihedral plug mounted in the tracer well of a set of fins FIG. 3 Radar radiation path during contact with the tracer well plug.
Figure 3:
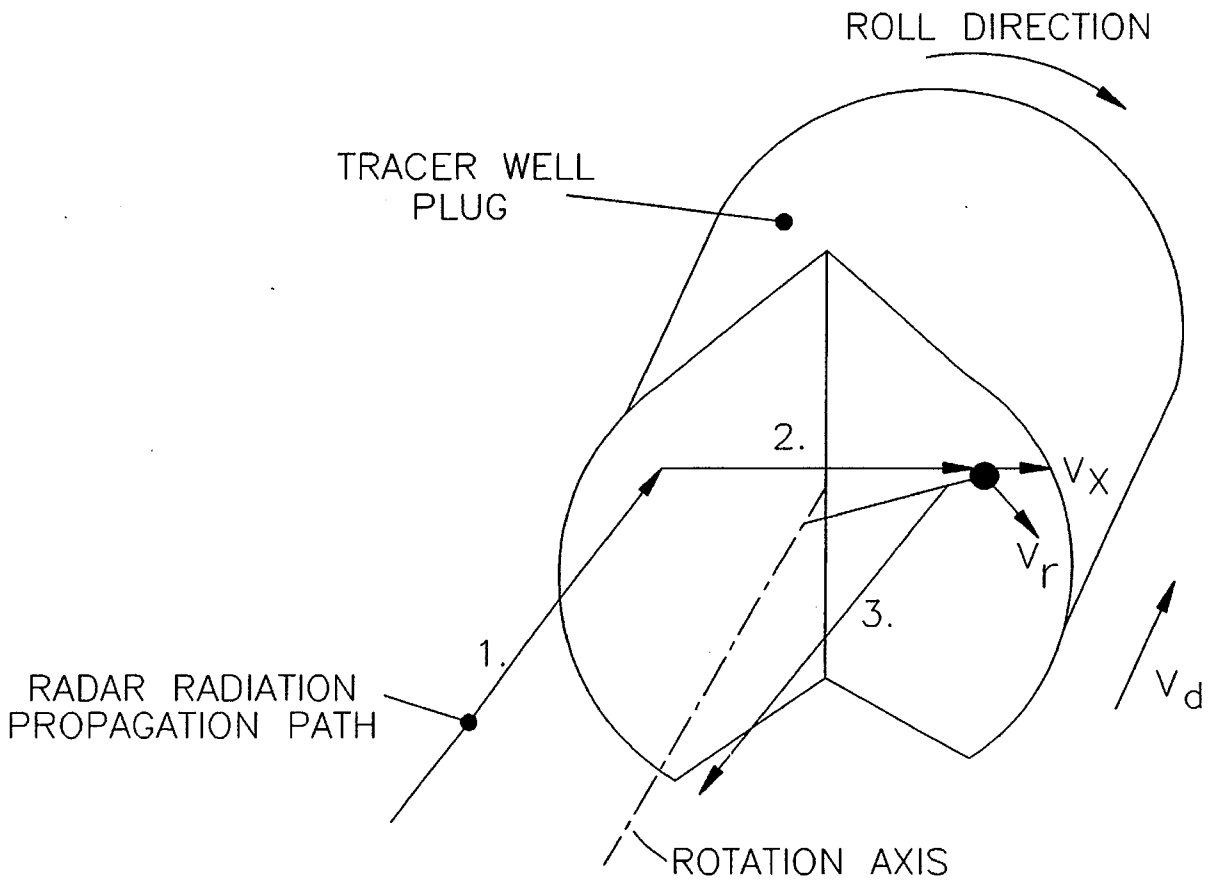

A drawing of the dihedral plug 10 is shown in FIG. 2. The plug consists of a piece of metallic circular stock (aluminum in this case) which has a right angle corner machined into one end. The opposite end is threaded to screw into the rear of a KE penetrator 11 (see FIG. 1). The dihedral plug 10, because of its dimensions, will produce a small amplitude variation in a retro-reflected, linearly polarized X-band radar signal as it rotates. Twice during each penetrator 11 revolution, the magnitude of the reflected radar signal off the back end is slightly enhanced. A ninety degree corner reflector will not exhibit any rotational anisotropy with respect to a linearly polarized radar's E field direction if its dimensions are at least several wavelengths in size. This is considered to be the optical regime for its Radar Cross Section (RCS) (Knott, E. F., *The Radar Handbook 2nd Edition,* Skolnick, M. I., pp. 11.4–11.6, McGraw Hill, 1990). As for the dihedral plug 10 shown in FIG. 2, its diameter is less than or approximately equal to the wavelengths of X-band microwaves (2.5–3.75 cm). In this regime, the size of the reflecting surface aligned with a linearly polarized radar's E field direction will greatly affect the magnitude of the reflected signal, and hence its RCS. When a radar's E field is oriented parallel to the vertical axis of the dihedral (see FIG. 2), it is aligned with the reflecting surface's maximum dimension (up to the diameter D). In contrast, when the E field is rotated 90 degrees with respect to the axis of the dihedral, it is aligned with the reflecting surface's smaller dimension (up to ½ the diameter). This size differential and the fact that the sizes involved are on the order of or less than the radar's wavelength is what gives rise to the anisotropy in RCS as the plug is rotated about its axis. The RCS of the dihedral plug will have a rotational dependence of $$RCS \propto A|\cos(\theta)|+const.$$

or $$RCS \propto A|\cos(2\pi f_s t)|+const.$$

where $f_s$ is its spin frequency and t is time.

A KE projectile 11 fitted with a dihedral plug 10 in place of its tracer, should therefore produce a changing return signal when illuminated from behind by a linearly polarized radar signal due to rotation of the plug with respect to the radar's E field direction. By recording this modulated signal and doing a simple analysis, the spin rate of the KE penetrator as a function of time can be obtained. As soon as the radar picks up the projectile, a modulation will be observed until the radar can no longer track it because it is too far downrange.

In the case of a Doppler radar, the total Doppler signal is the combined result due to the forward velocity of the projectile and a small but hopefully detectable portion due to the rotation of the tracer well dihedral plug. This small signal from the dihedral plug will have maximum return twice per revolution and therefore produce a frequency modulation (FM) on top of the total Doppler return signal. Again, after simple analysis, the spin history of the points at a shallower depth posses more tangential velocity and will produce a larger Doppler shift than those at the deeper depths. The larger the Doppler shift, the easier it will be resolved by the radar.

Figure 4A:
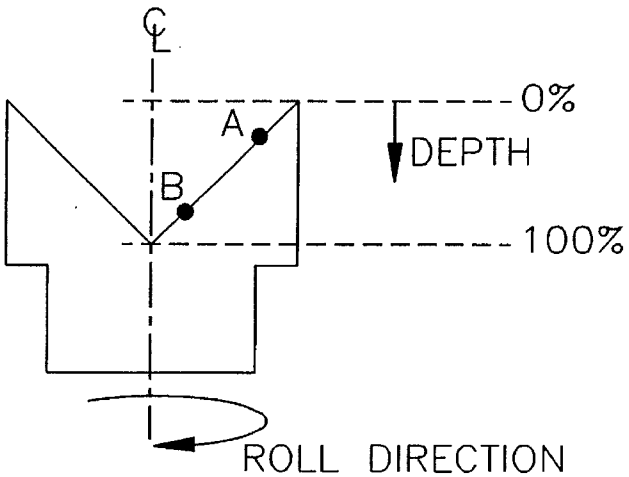
FIG. 4*a* Diagram of dihedral plug showing tangential velocity vs. depth into plug.
Figure 4B:
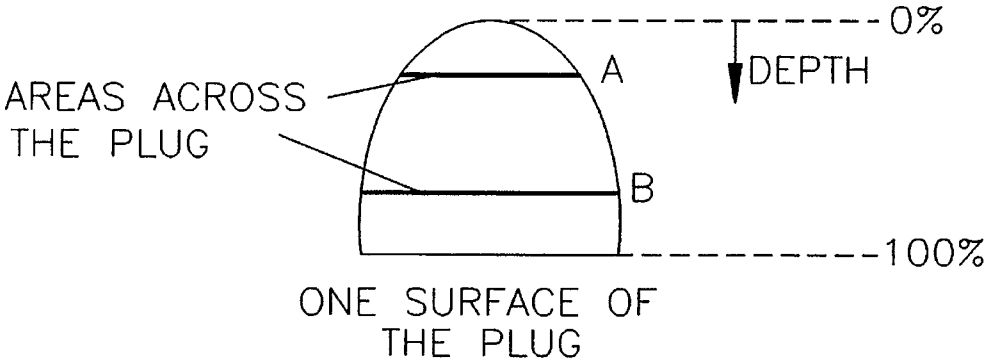
FIG. 4*b* Diagram of dihedral plug showing differential area vs. depth into plug.

The differential surface area on the plug also varies with depth. This area increases with depth as seen in FIG. 4. Again, the Doppler signals produced by the regions of larger surface area are more readily detected since the amount of radiation reflected back to the radar is directly proportional to this area. The radar will pick up the signals with the higher reflected power.

Figure 5:
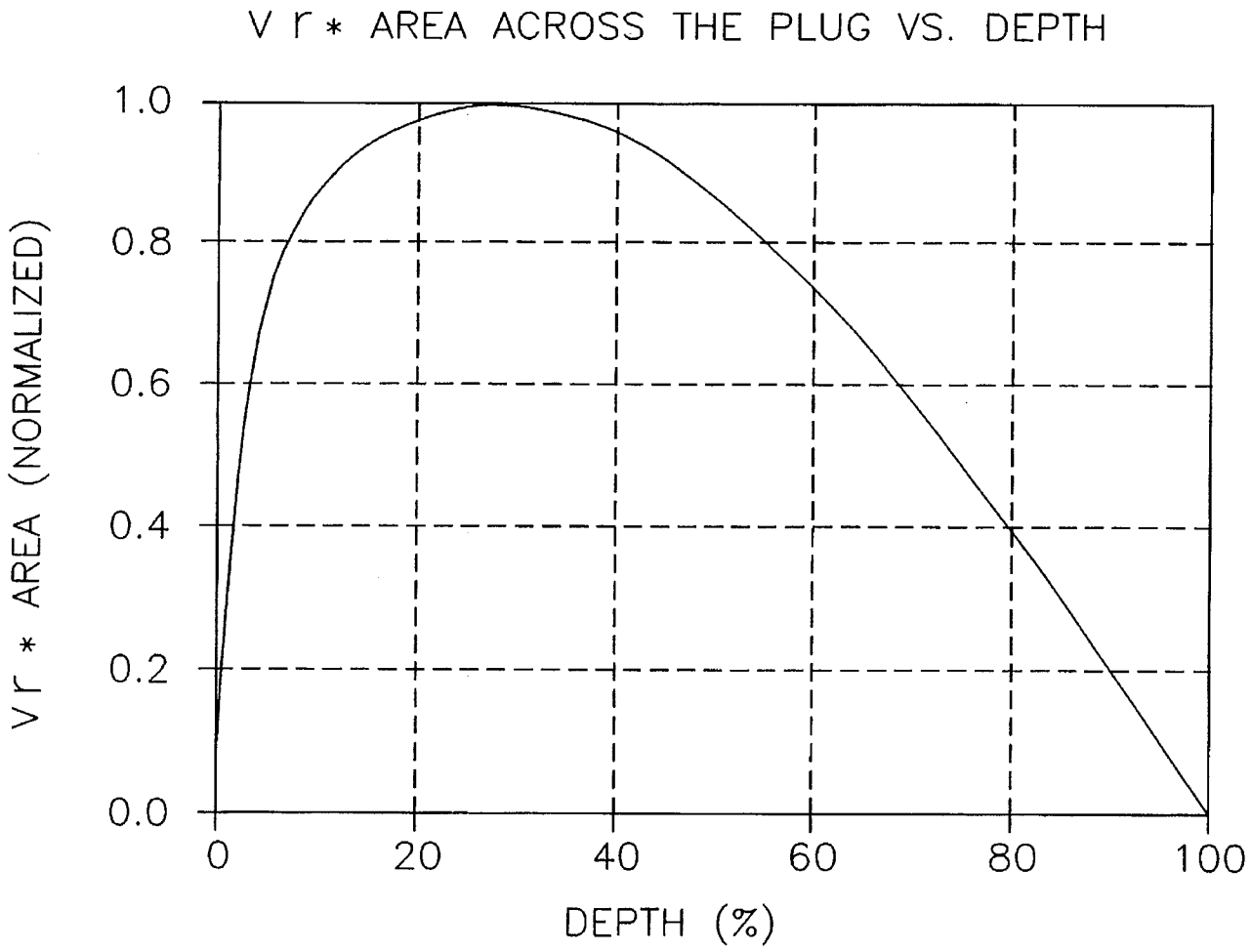
FIG. 5 Depth when $V_r$ and area across the plug are optimized.

There exists a depth where the combination of these two functions is optimized. This depth can be estimated by finding the maximum of the product of the tangential component of $V_r$ and the surface area across the plug as functions of depth. FIG. 5 shows a plot of this product vs. depth. The depth at which these properties are optimized was found to be approximately 29% into the plug. With this value, $|v_r|$ can be approximated by:

$$|v_r|=2\pi(.7\ I\ D)f_s$$

or $$|V_r|=1.36\pi D f_s/\lambda$$

where $|V_r|$ is the magnitude of the effective tangential velocity of the points on the plug's surface due to plug rotation, D is the maximum depth of the plug, and $f_s$ is the penetrator spin frequency. This tangential velocity will cause a Doppler shift frequency:

$$f_{d2}=|V_r|/\lambda$$

or $$f_{d2}=1.36\pi D f_s/\lambda$$

This Doppler shift from the dihedral plug will be in addition to the Doppler shift due to the velocity of the projectile with respect to the radar. The fact that the dihedral plug has optimum reflection of a linearly polarized radar signal in the X-band frequency range at certain orientations as described earlier ($|\cos(\theta)|$ dependence) means that the small Doppler signal originating from the rotation of the plug will also be modulated. It is this modulated small Doppler signal from the dihedral plug, on top of the regular Doppler signal observed from a standard KE penetrator, which can be analyzed to produce the spin history of the penetrator as it flys down range. Test results in the next section have produced Doppler return signals of the type described above, and the spin rate of a KE penetrator fitted with a dihedral tracer well plug has been determined.

Figure 6:
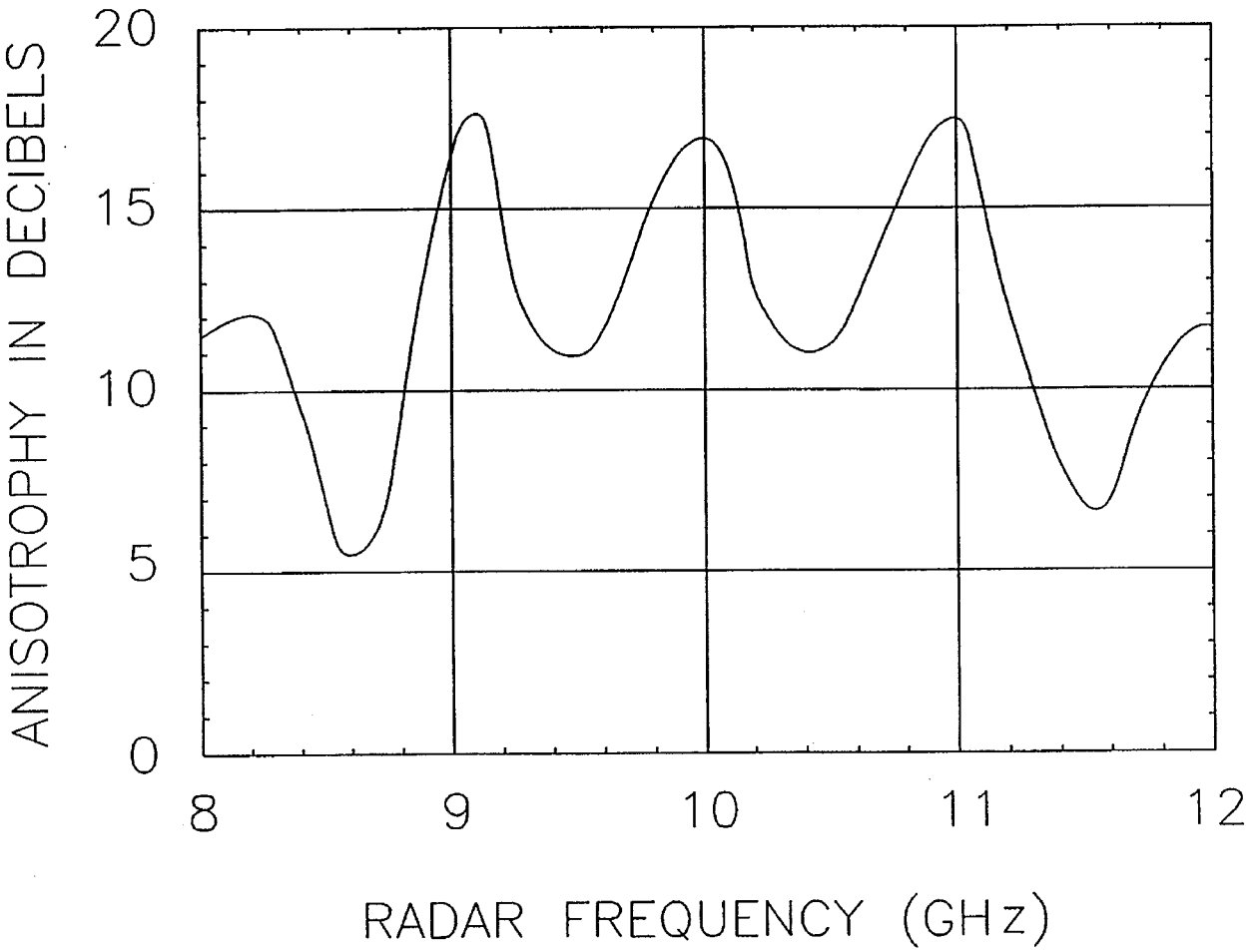
FIG. 6 Plot of maximum anisotropy vs. frequency observed when the set of fins with dihedral plug (see FIG. 2) are rotated about their central axis.

A fin section from a KE penetrator fitted with the dihedral plug was positioned in an anechoic chamber, and its radar return was measured at different rotational angles with respect the E field of the radar. The maximum value of the orientational anisotropy vs. frequency obtained from these static tests is shown in FIG. 6. For the same set of fins fitted with a standard tracer, very little (less than 1.5 dB at 10 GHz) anisotropy in RCS was observed as the fins were rotated about their central axis. It is little wonder that spin has not been detected from radar data on a standard KE projectile. For the case of the projectile with the dihedral tracer well insert, greater than 11 dB anisotropy is observed in the 9–11 GHz frequency range, making possible the extraction of spin from radar return data. For radars of higher frequency (shorter wavelength), plugs of corresponding smaller dimensions could be utilized, providing enough signal power from the radar is available for the smaller corner reflector to be detected downrange.

Figure 7C:
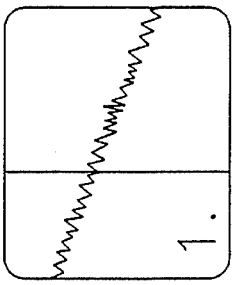
FIG. 7*c* Enlargement shows modulated FM doppler signal due to rotation.
Figure 7A:
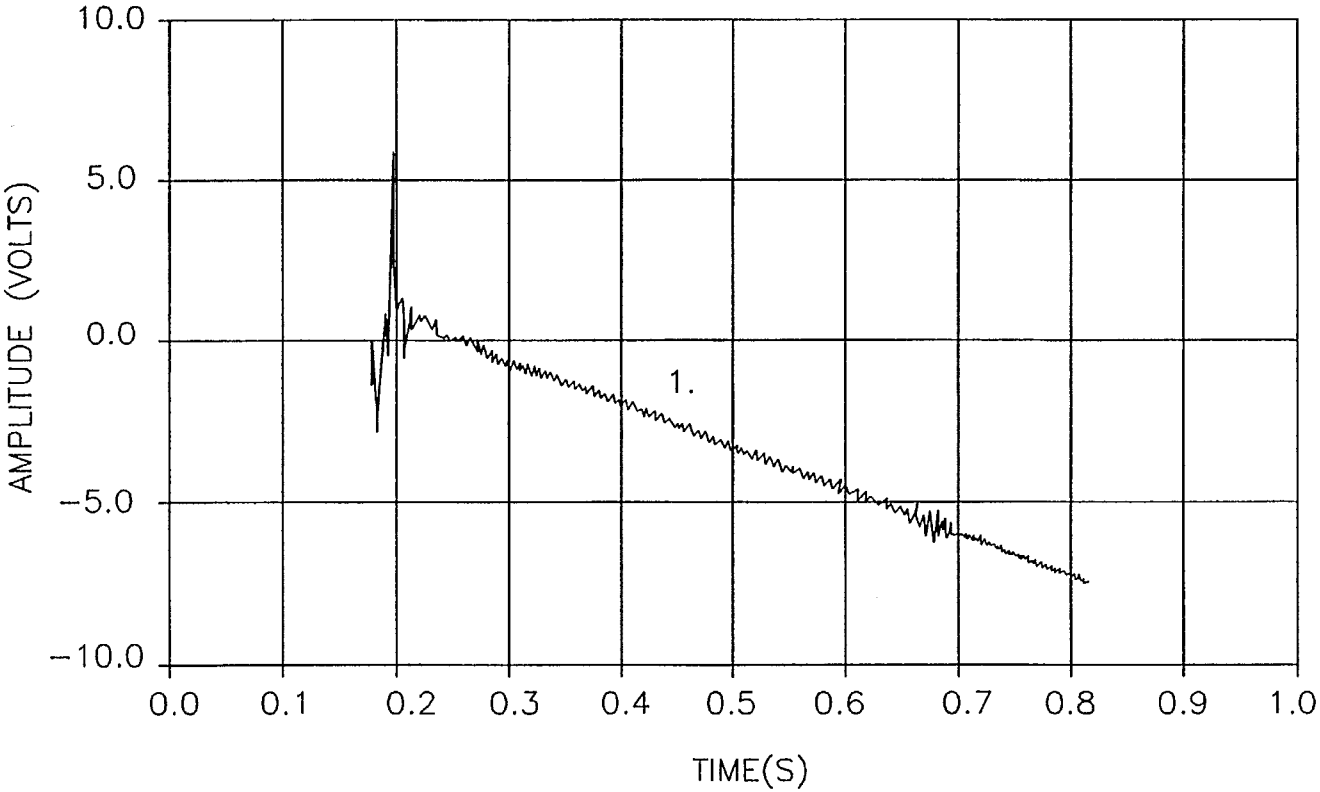
FIG. 7*a* Discriminated Doppler radar data from KE projectile with dihedral tracer well plug.
Figure 7B:
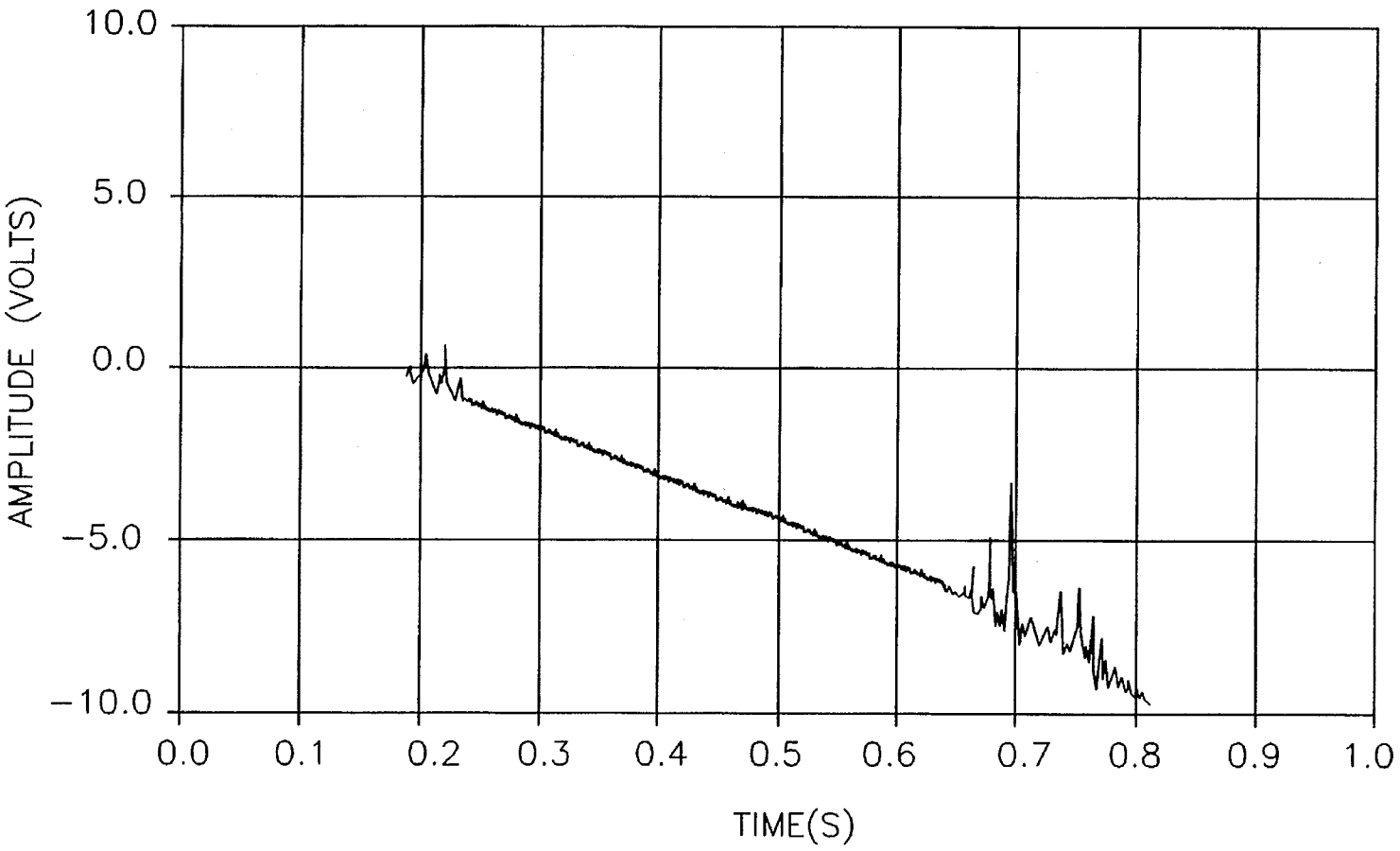
FIG. 7*b* Discriminated Doppler radar data from a projectile without the tracer well plug.

Verification of the magnitude modulation of the radar signal for an actual fired KE penetrator fitted with a tracer well dihedral plug was attempted at Aberdeen Proving Ground (APG). The available test radar was a HAWK X-band Doppler radar. We found, however, we could not extract direct amplitude signals from the radar because of its AGC (automatic gain circuitry), the tests were performed with the dihedral plug and a with a standard tracer insert, and the Doppler signal voltage was recorded and examined. The dihedral tracer plug was found to produce an FM in the Doppler return signal measured by the HAWK radar due to the velocity of the projectile. Plots shown in FIG. 7 were obtained by inputing recorded Doppler data into a standard telemetry frequency discrimator which converts input frequency to a DC output voltage. FIG. **7*a* shows discrimator data obtained from a penetrator fitted with the dihedral plug. A small periodic signal (FM) on top of the Doppler signal from the velocity of the penetrator (downward sloping signal) is clearly seen. FIG. 7*b*** shows data from a penetrator fitted with a standard tracer in the tracer well. No FM is observed in this discriminated Doppler return data, demonstrating that the effect is due to the dihedral tracer well plug.

Figure 8:
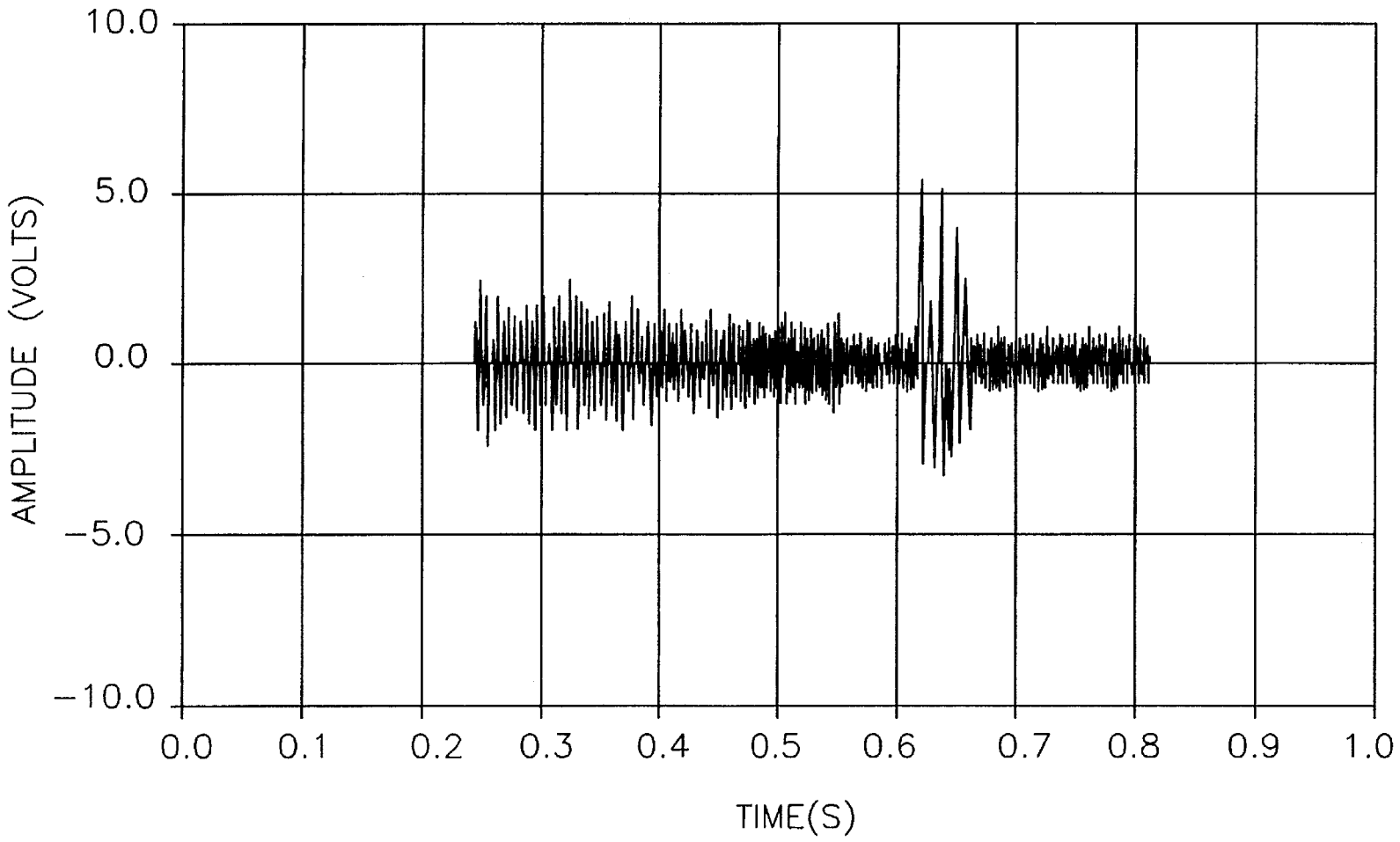
FIG. 8 Band pass filtered, discriminated data of projectile with the tracer well plug.
Figure 9:
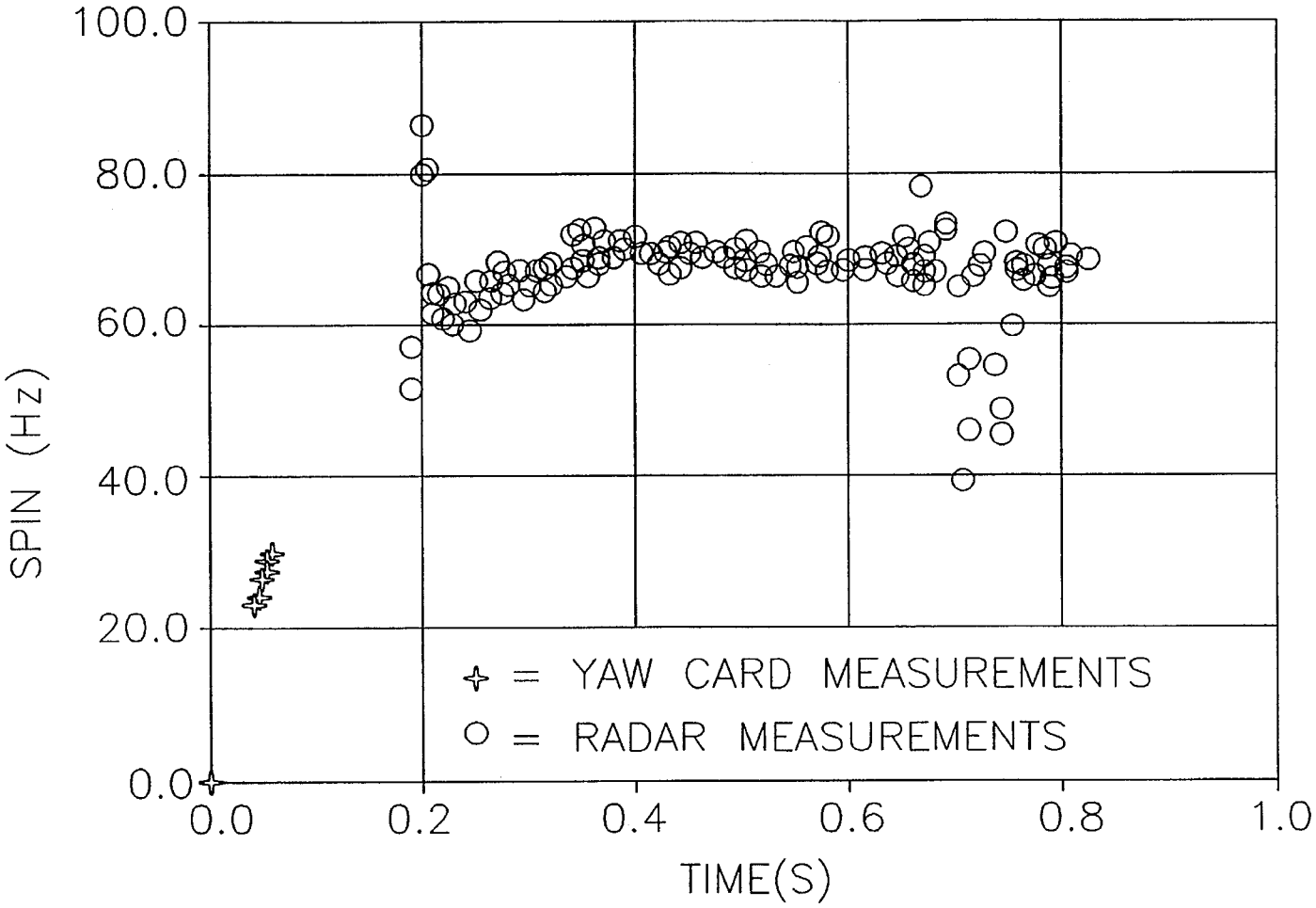
FIG. 9 Spin of penetrator P1 fired with dihedral plug obtained by analyzing the discriminated Doppler return signals.
Figure 10:
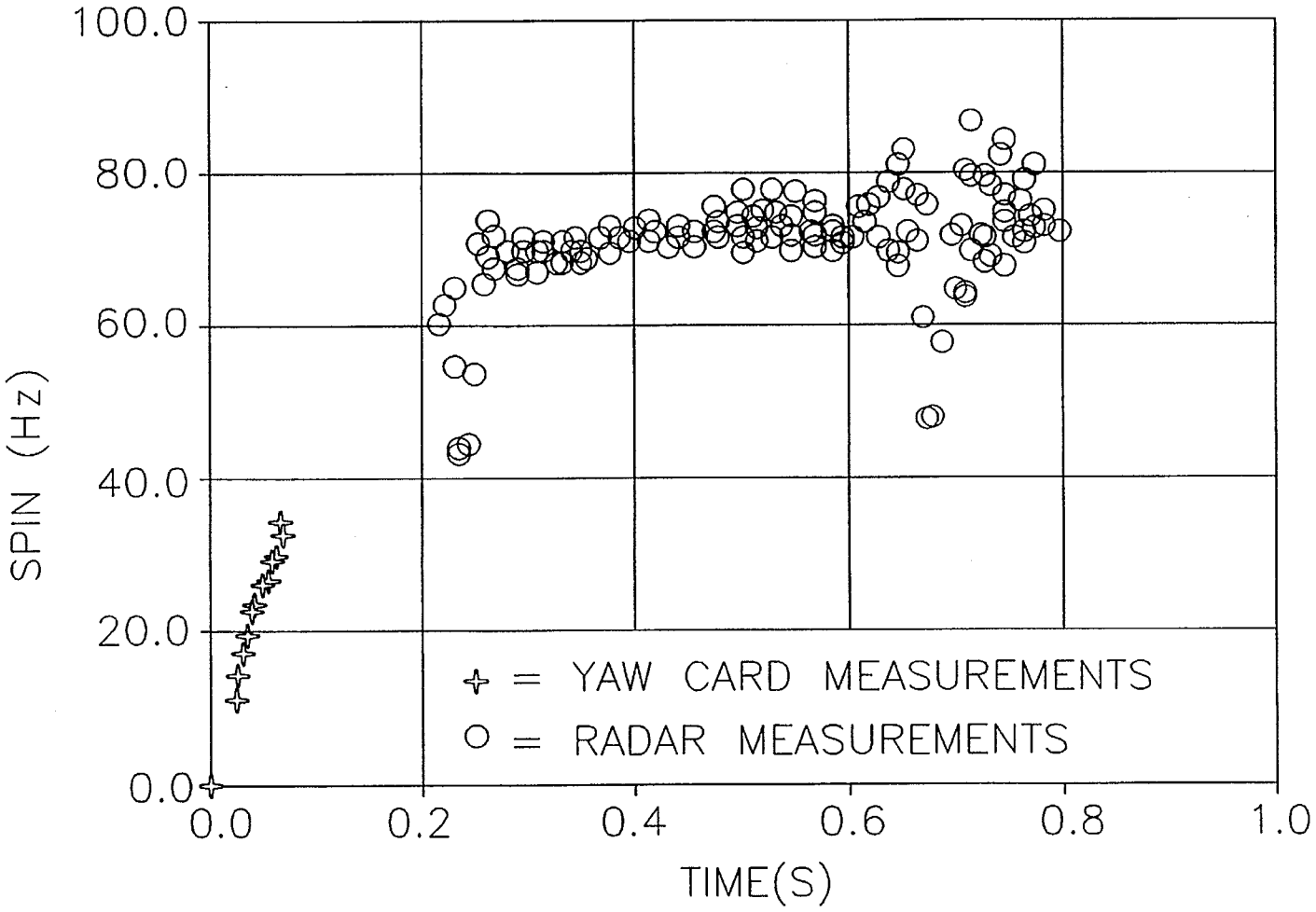
FIG. 10 Spin of penetrator P2 fired with dihedral plug obtained by analyzing the discriminated Doppler return signals.
Figure 11:
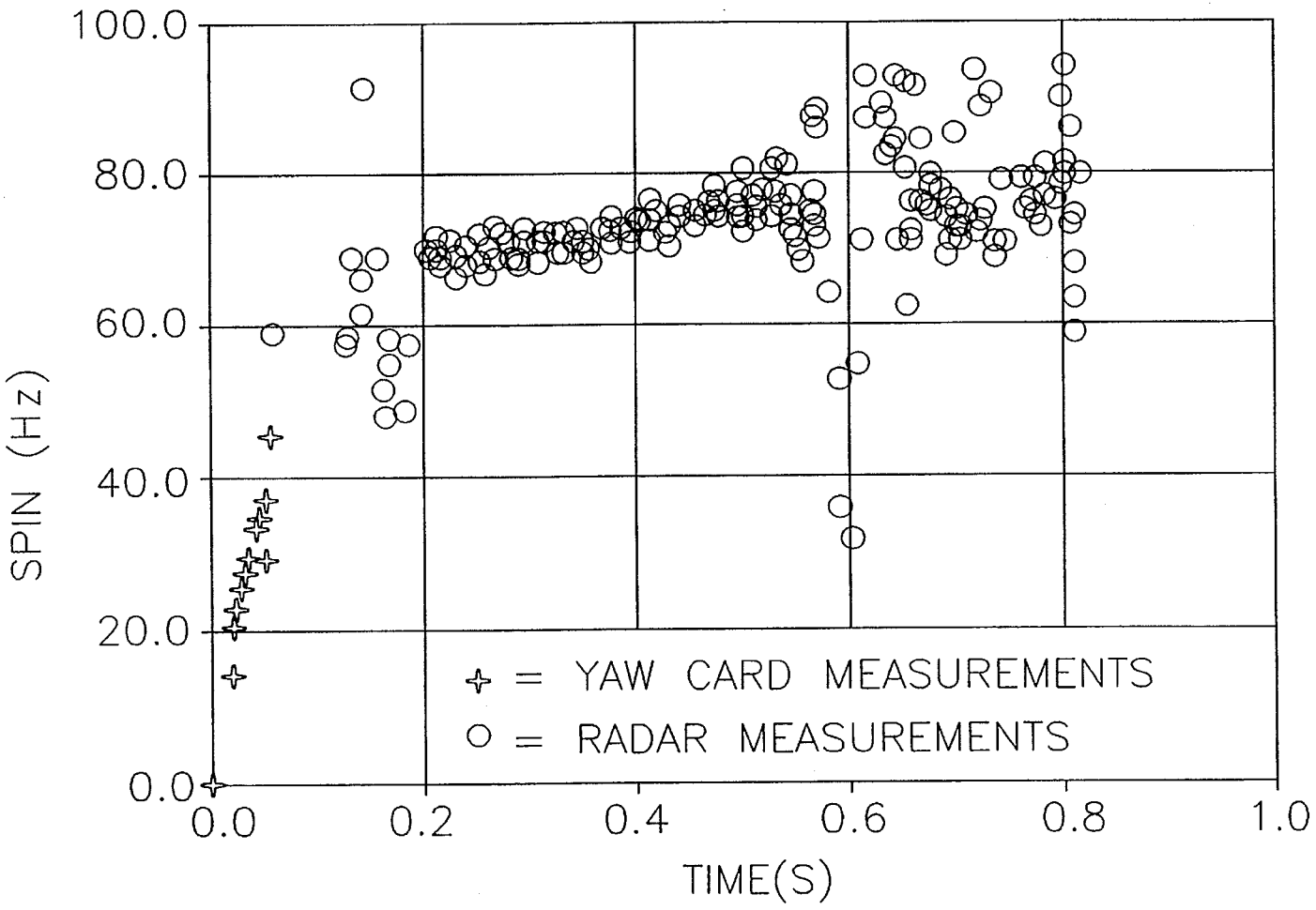
FIG. 11 Spin of penetrator P3 fired with dihedral plug obtained by analyzing the discriminated Doppler return signals.
Figure 12:
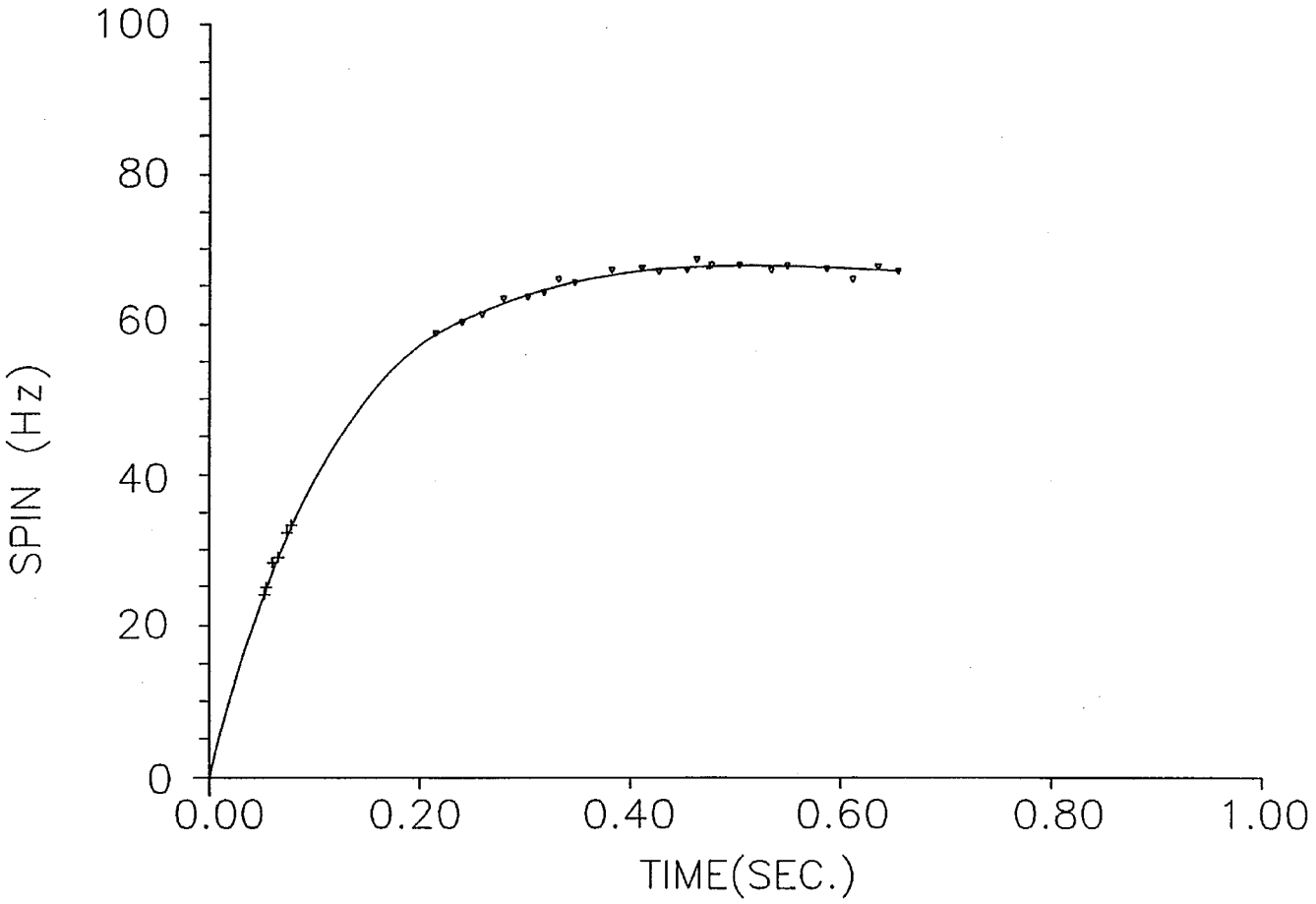
FIG. 12 Spin history data and curve fit of averaged data from FIG. 9.

FIG. 8 presents the data from FIG. **7*a* after being filtered to reduce high-frequency noise and the downward slope due to the velocity of the penetrator. Filtered data were then digitized and analyzed by computer to find the zero crossings. The projectile spin rate is half the zero crossing frequency because the plug has maximum reflections twice per revolution, The spin frequency vs. time plots for three KE penetrators fitted with a dihedral plugs are shown in FIGS. 9–11**. These plots show realistic spin rates and histories for the type of projectiles that were tested (Brandon, F. J., *Private Communication*). Data points designated by the plus (+) symbols were obtained by measuring the projectile fin signatures from yaw cards positioned for each test firing. These data were kindly provided by R. A. Pennekamp. Reasonable spin data was obtained out to 0.65 seconds (approximately 1000 meters or 0.6 miles) where noise or interference from downrange clutter overwhelms returned signal. FIG. 12 shows data from FIG. 9 which have been further processed by averaging every five data points. The curve shown was generated by fitting the data to a 4th degree polynomial. Spin data points from the beginning and end of the radar's track (where there is large scatter in the data) have been dropped. The yaw card data is seen to fall very close to the curve fit, and a reasonable spin history to 0.65 seconds or 1000 meters is displayed.

Figure 13:
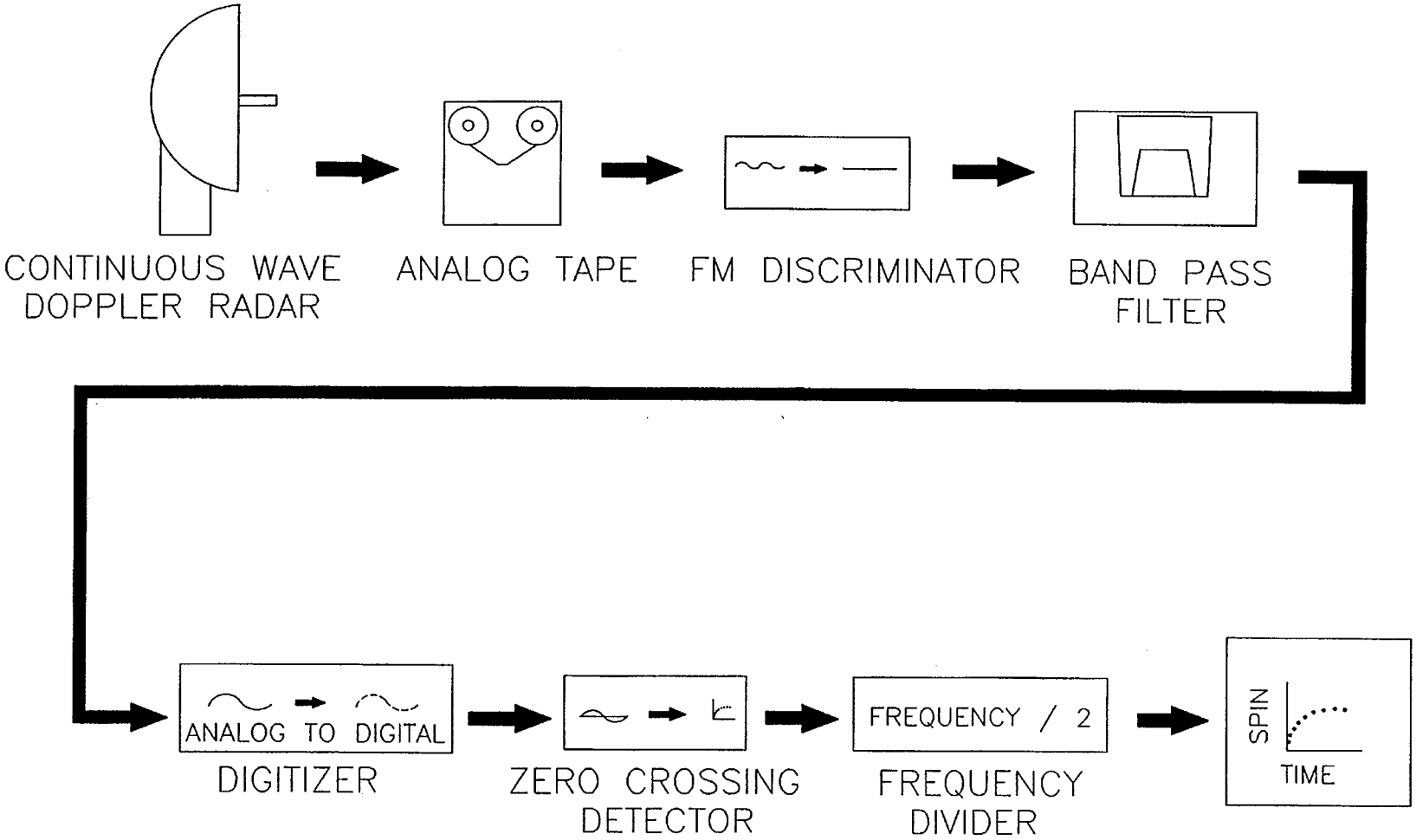
FIG. 13 Block diagram of equipment used to reduce the Doppler data.

A block diagram of the equipment and analysis process used to obtain the spin history of the KE penetrators fitted with the dihedral plug is shown in FIG. 13.

Having described this invention, it should be apparent to one skilled in the art that the particular elements of this invention may be changed, without departing from its inventive concept. This invention should not be restricted to its disclosed embodiment but rather should be viewed by the intent and scope of the following claims.

What is claimed is:

1. A projectile spin rate measurement system comprising:

a dihedral radar reflector means mounted on a projectile, antenna means connected to a radar system for illuminating said dihedral radar reflector means, measurement means connected to said radar system for detecting and measuring an amplitude variation in a radar signal reflected from said dihedral radar reflector means mounted on said projectile when said projectile is spinning in flight, wherein a diameter of said dihedral radar reflector means is approximately equal to the wavelength of said radar system, and further wherein said radar system is a linearly polarized radar system.

2. A projectile spin rate measurement system as in claim 1 wherein said diameter of said dihedral radar reflector means is less that the wavelength of said radar system.

3. A projectile spin rate measurement system as in claim 1 wherein said dihedral radar reflector means comprises a metal plug which has a right angle corner reflector machined into one end of said metal plug.

4. A projectile spin rate measurement system as in claim 3, wherein said dihedral plug when mounted on a projectile and illuminated by an X-band radar produces amplitude modulation of the reflected radar signal.

5. A projectile spin rate measurement system as in claim 4, wherein said dihedral plug produces modulation of the doppler frequency of said reflected radar signal.

* * * * *